US010612222B2

(12) United States Patent
Hillsten

(10) Patent No.: US 10,612,222 B2
(45) Date of Patent: Apr. 7, 2020

(54) SYSTEM AND METHOD FOR DIVERTING THE FLOW OF LIQUID AND DEBRIS AROUND A CROSSBAR OF A DRAIN

(71) Applicant: Justin Hillsten, Glendale, AZ (US)

(72) Inventor: Justin Hillsten, Glendale, AZ (US)

(73) Assignee: Justin Hillsten, Glendale, AZ (US)

( * ) Notice: Subject to any disclaimer, the term of this patent is extended or adjusted under 35 U.S.C. 154(b) by 0 days.

(21) Appl. No.: 15/957,372

(22) Filed: Apr. 19, 2018

(65) Prior Publication Data

US 2018/0355595 A1 Dec. 13, 2018

Related U.S. Application Data

(60) Provisional application No. 62/517,546, filed on Jun. 9, 2017.

(51) Int. Cl.
*E03C 1/264* (2006.01)

(52) U.S. Cl.
CPC ..... *E03C 1/264* (2013.01)

(58) Field of Classification Search
CPC ..... E03C 1/264
USPC ..... 4/292
See application file for complete search history.

(56) References Cited

U.S. PATENT DOCUMENTS 4,044,409 A * 8/1977 Hood ..... E03C 1/264 4/286
8,875,727 B2 * 11/2014 Wroblewski ..... E03F 5/0407 137/15.09
D785,417 S * 5/2017 Bagley ..... D7/695
D832,664 S * 11/2018 Degerland ..... D7/700
2004/0015185 A1 * 1/2004 Ewers ..... A61B 17/0293 606/213
2009/0271920 A1 * 11/2009 Viggiano ..... E03C 1/264 4/292
2010/0000012 A1 * 1/2010 Evans ..... E03C 1/29 4/292

(Continued)

FOREIGN PATENT DOCUMENTS

DE 1998110386 9/1999

OTHER PUBLICATIONS

Tub Shroom, https://www.amazon.com/TubShroom-Revolutionary-Protector-Catcher-Strainer/dp/B01BYMTYBS/ref=sr_1_2_sspa?ie=UTF8&qid=1524001296&sr=8-2-spons&keywords=mushroom+drain&psc=1.

(Continued)

*Primary Examiner* — Lori L Baker
(74) *Attorney, Agent, or Firm* — Lisa Foundation Patent Law Clinic at Arizona State University

(57) ABSTRACT

A device and method for diverting the flow of water and debris around a crossbar of a drain is disclosed. The device comprises a funnel with a flexible chute, a flexible ring, a bottom surface, a first sidewall, and a second sidewall. The funnel may also comprise a gasket. The flexibility of the chute and the ring allow the funnel to be compressed to fit drains of various diameters. The chute may contain one or more slits or one or more louvers. The bottom surface of the funnel sits on the crossbar of the drain and diverts the flow of water and debris to a quadrant of the drain. The funnel and gasket comprise a thermoplastic. The funnel may be manufactured by a single-step injection molding process, a multi-step injection molding process, a liquid silicone rubber molding or a cutting-and-folding process.

20 Claims, 20 Drawing Sheets

(56) References Cited

U.S. PATENT DOCUMENTS

| | | | | |
|---|---|---|---|---|
| 2011/0046449 | A1* | 2/2011 | Minnelli | A61B 1/00128 600/205 |
| 2015/0344279 | A1* | 12/2015 | Levy | B67C 11/02 141/86 |
| 2016/0022083 | A1* | 1/2016 | Archuleta | A47J 19/005 99/495 |
| 2016/0227954 | A1* | 8/2016 | Chang | A47J 17/02 |
| 2017/0119923 | A1* | 5/2017 | Gunatillake | C08G 77/46 |
| 2017/0188740 | A1* | 7/2017 | Shicheng | A47J 27/002 |
| 2018/0289187 | A1* | 10/2018 | Love | A47G 19/34 |
| 2018/0317680 | A1* | 11/2018 | Povey | A47G 19/22 |

OTHER PUBLICATIONS

Squish Sink Strainer, https://www.amazon.com/ROBINSON-HOME-PRODUCTS-Squish-Strainer/dp/800LKOLMT8.

* cited by examiner

SYSTEM AND METHOD FOR DIVERTING THE FLOW OF LIQUID AND DEBRIS AROUND A CROSSBAR OF A DRAIN

CROSS REFERENCES TO RELATED APPLICATIONS

The present patent application is a nonprovisional and claims benefit under 35 U.S.C. § 119(e) of U.S. Provisional Application No. 62/517,546, filed on Jun. 9, 2017, the disclosures of which are hereby incorporated by this reference in their entirety.

BACKGROUND

1. Field of the Invention

The present disclosure relates generally to funnels used to divert the flow of liquid and debris around a crossbar of a drain of a basin such as a tub or a sink. Such devices may be used in applications where it is desired to reduce the amount of debris such as human hair that is caught by the crossbars of drains. In particular, funnels that divert the flow of liquid and debris around the crossbars of drains are desired in applications such as showers, bathtubs, sinks, and other basins that are commonly used for washing, rinsing, and generally caring for hair.

2. Description of Related Materials

The drains of most basins, such as tubs and sinks, contain diametric or radial crossbars. The crossbars allow a tub stopper or grate to fit into the general space. Additionally, the crossbars aid in the installation of the drain. Various drain sieves and traps have been developed to further restrict the flow of debris. Several issues accompany the use of such crossbars, sieves and traps. For example, drain crossbars, sieves and traps tend to block the flow of water down the drain as they accumulate debris, and thus require regular manual cleaning to function properly. Drain crossbars, sieves, and traps that have accumulated organic debris such as human hair and residue from hygiene products are both unsightly and unsanitary and often promote the growth of microbes.

To reduce the complexity and length of the Detailed Specification, and to fully establish the state of the art in certain areas of technology, Applicant(s) herein expressly incorporate(s) by reference all the following materials identified in each numbered paragraph below.

German patent 19810386 of Kaspschak describes a wash basin outlet flow valve funnel has a filter screwed to the drain space crossbar. Between the filter and cross bar is an outlet valve funnel which surrounds the bar, so that the waste water does not come into contact with the bar.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY OF THE INVENTION

Embodiments of the present invention provide among other things a funnel for a drain in a basin. The invention may comprise a chute that is configured to divert liquid and debris into a quadrant of the drain. The chute may be defined by a lofting function. The lofting function may take two planar surfaces as parameters and define a continuous series of planar sections along a linear path between them. The parameters of the lofting function may be a ring and a bottom surface. The chute may be compressible to fit within the drain.

The chute may be coupled to the ring. The ring may comprise a first ring terminus and a second ring terminus. The arc of the ring may measure approximately 180 to 360 degrees between the first ring terminus and the second ring terminus. The ring may be compressible to fit within the drain. The ring may be coupled to a gasket. The gasket may comprise a thermoplastic elastomer.

The chute may also be coupled to the bottom surface. The bottom surface may comprise a first bottom edge and a second bottom edge. The first bottom edge and the second bottom edge may be disposed in approximately a right-angle with respect to one another. The bottom surface may be configured to rest on a crossbar of the drain.

The chute may also be coupled to a first sidewall and a second sidewall. The first sidewall and the second sidewall may also be configured to couple to the ring and the bottom surface. A curvature of the first sidewall and a curvature of the second sidewall may be configured to be the same as a curvature of the ring.

The first ring terminus, the second ring terminus, the first sidewall, the second sidewall, the first bottom edge, and the second bottom edge may define a void space therebetween.

The chute, the ring, the bottom surface, the first sidewall, and the second sidewall may comprise a thermoplastic elastomer. The thermoplastic may comprise acrylonitrile butadiene styrene, thermoplastic vulcanizates, thermoplastic elastomers, thermoplastic urethanes or polyethylene. The thermoplastic may comprise an antimicrobial additive.

The chute, the ring, the bottom surface, the first sidewall, and the second sidewall may comprise a silicone or a thermoplastic. The thermoplastic may comprise acrylonitrile butadiene styrene, thermoplastic vulcanizates, thermoplastic elastomers, thermoplastic urethanes or polyethylene.

The chute, the ring, the bottom surface, the first sidewall, and the second sidewall may comprise a coating. The coating may be hydrophobic and antimicrobial.

The chute may comprise as least one slit. The at least one slit may be defined by a projection of a polygon on to a surface of the chute from a plane of the bottom surface. At least one vertex of the polygon may be modified by a filleting function. The filleting function may round off the at least one vertex of the polygon according to a radius. The polygon may be a concave hexagon. The concave hexagon may comprise six 90-degree angles.

The chute may comprise at least one louver. The louver may be affixed anywhere on the chute and may vary in size.

The invention may be manufactured by an injection molding process. The injection molding process may comprise a unified molding of the chute, the ring, the bottom surface, the first sidewall, and the second sidewall, and an attachment of the gasket.

The invention may be manufactured by a multi-step liquid silicone rubber or thermoplastic elastomer (any other processes?) molding process. The multi-step thermoplastic elastomer molding process may comprise a unified molding of the chute, the ring, the bottom surface, the first sidewall, and the second sidewall, and a molding of the gasket.

The invention may be manufactured by a cutting-and-folding process. The cutting and folding process may comprise a cutting of the chute, the ring, the bottom surface, the first sidewall, and the second sidewall out of a solid piece of a material, a folding of the chute, the ring, the bottom surface, the first sidewall, and the second sidewall into a desired geometry, and an attachment of the gasket. The material may be polypropylene or a thermoplastic elastomer.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment, and their simplicity should not use to limit the scope of the invention.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
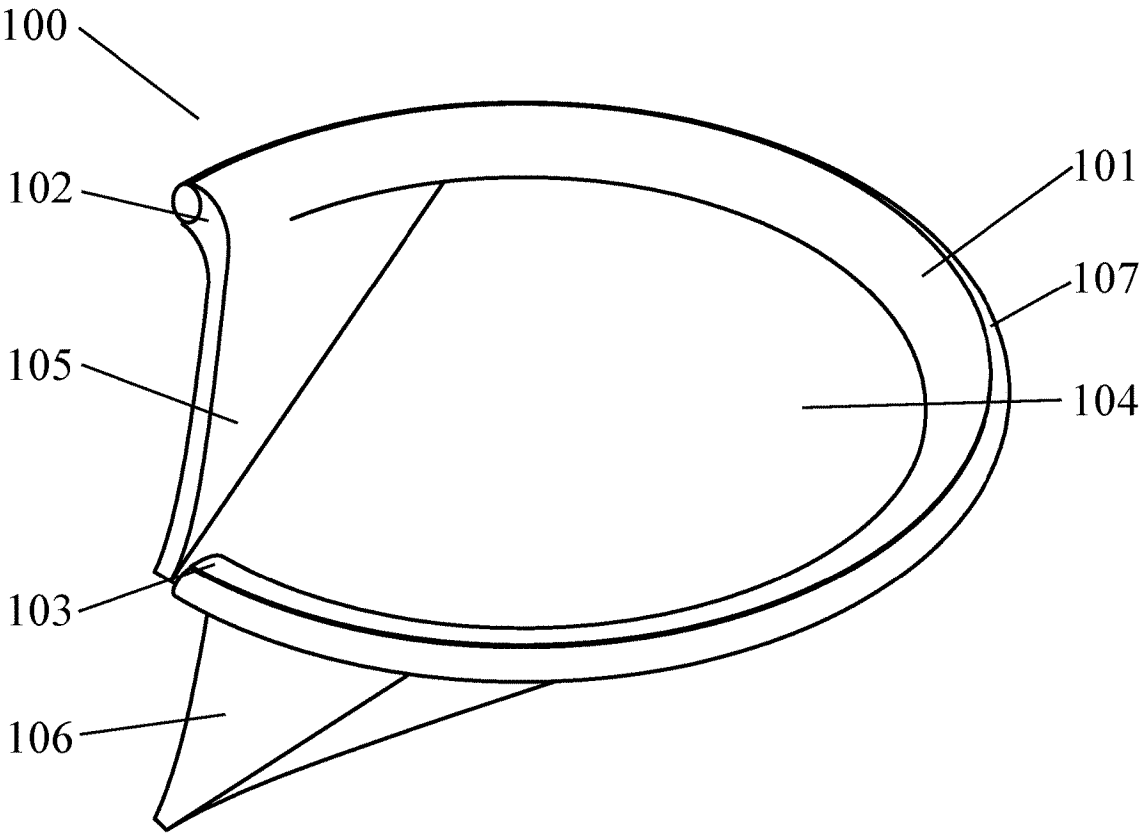
FIGS. 1-3 depict elevated, depressed, and axial perspective views of an embodiment of the drain funnel.
Figure 2:
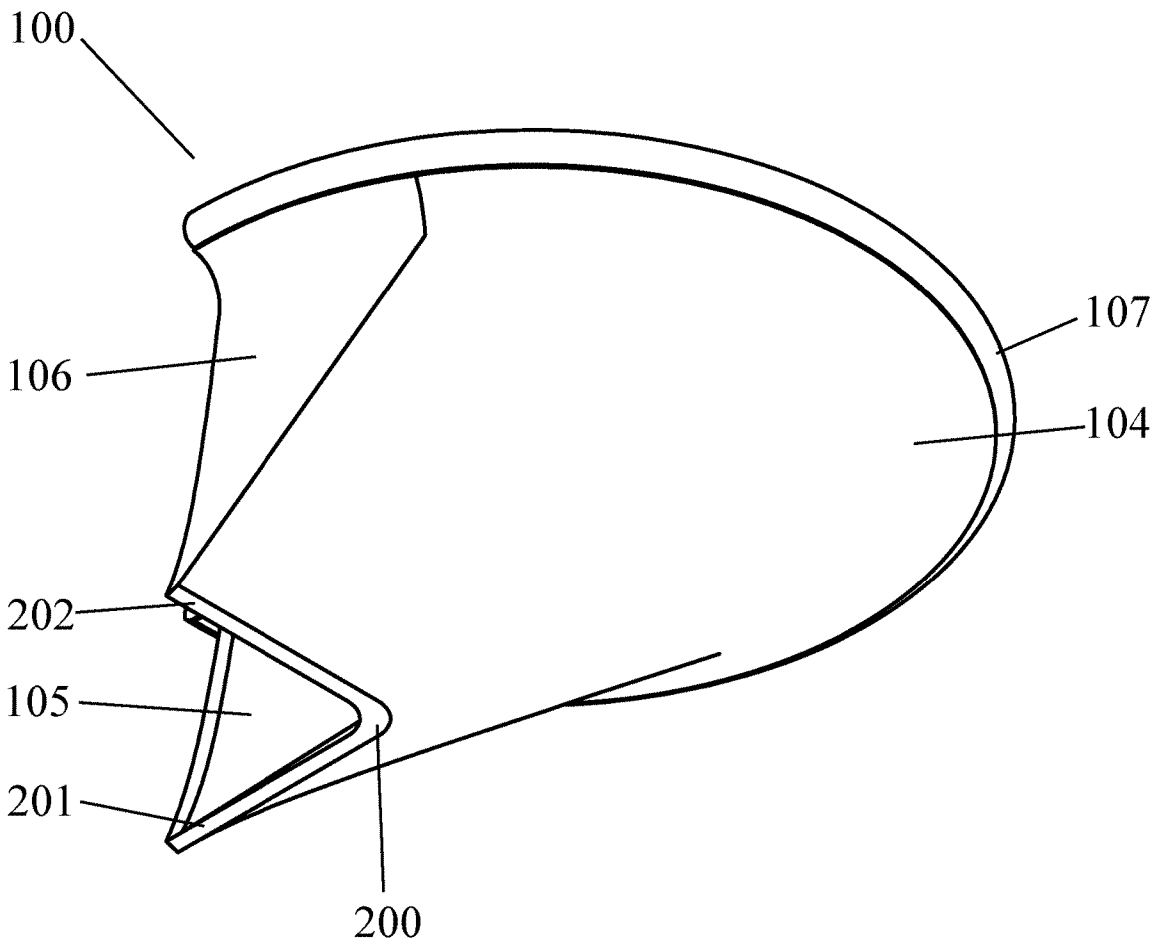
Figure 3:
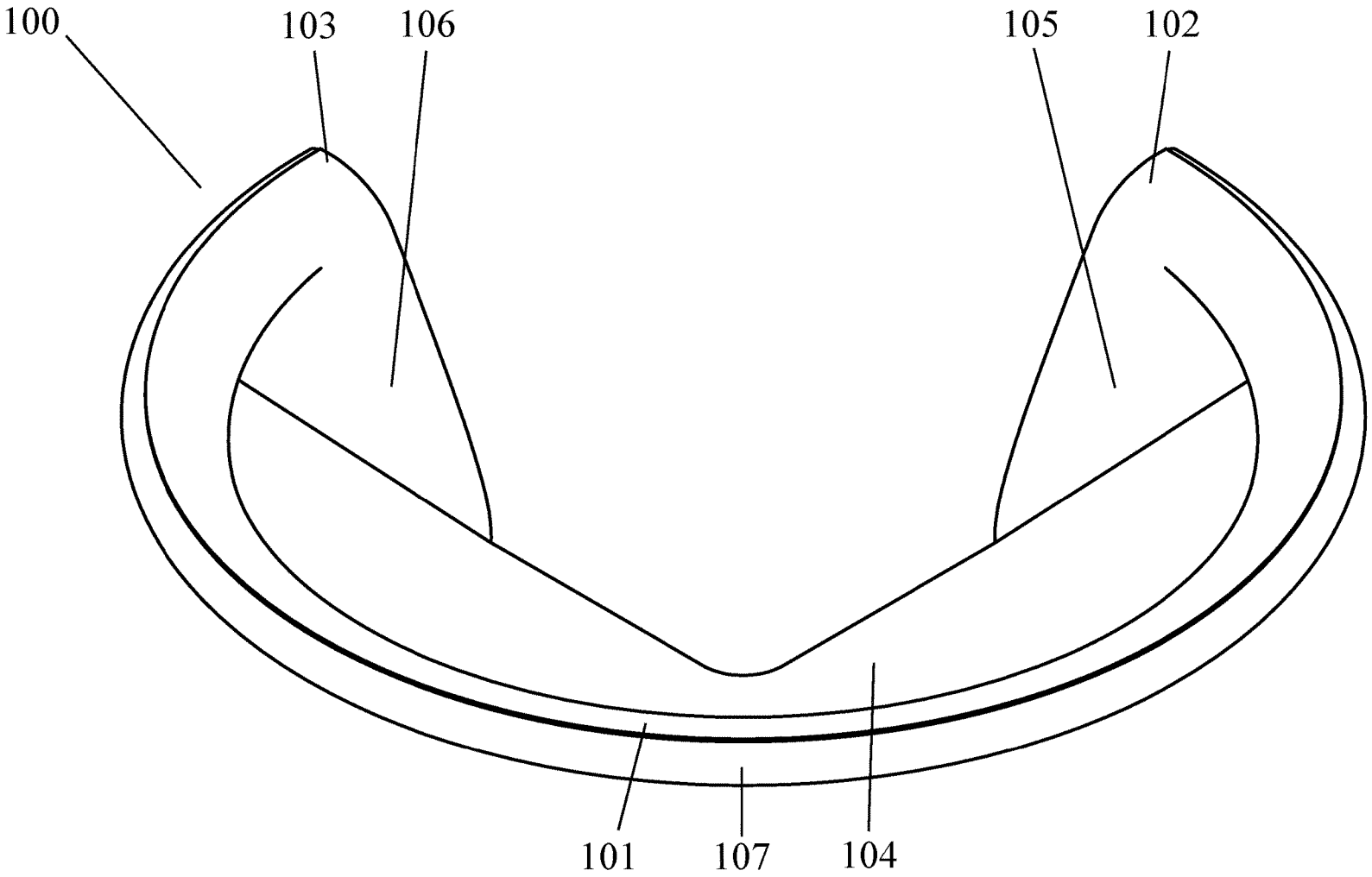

Referring to FIGS. 1-3, an elevated, depressed, and axial perspective view of an embodiment of the drain funnel 100 are illustrated, respectively, according to an embodiment of the invention. The drain funnel 100 comprises a ring 101. The ring 101 further comprises a first ring terminus 102 and a second ring terminus 103. In this embodiment, the ring 101 extends through approximately 180-360 of arc between the first ring terminus and the second ring terminus. A chute 104 is coupled to the ring. A first sidewall 105 and a second sidewall 106 are coupled to the ring 101 and the chute 104. In this embodiment, a gasket 107 may be coupled to the ring. In some embodiments, the gasket may be removable from the ring, in other embodiments the gasket may be permanently coupled to the ring. A bottom surface 200 with a first bottom edge 201 and a second bottom edge 202 is coupled to the chute 104. The first ring terminus 102, the second ring terminus 103, the first sidewall 105, the second sidewall 106, the first bottom edge 201, and the second bottom edge 202 form a void space therebetween. The void space allows for flexion in the ring 101 and the chute 104, allowing the diameter of the ring 101 to be compressed to fit drains of varying sizes.

Figure 4:
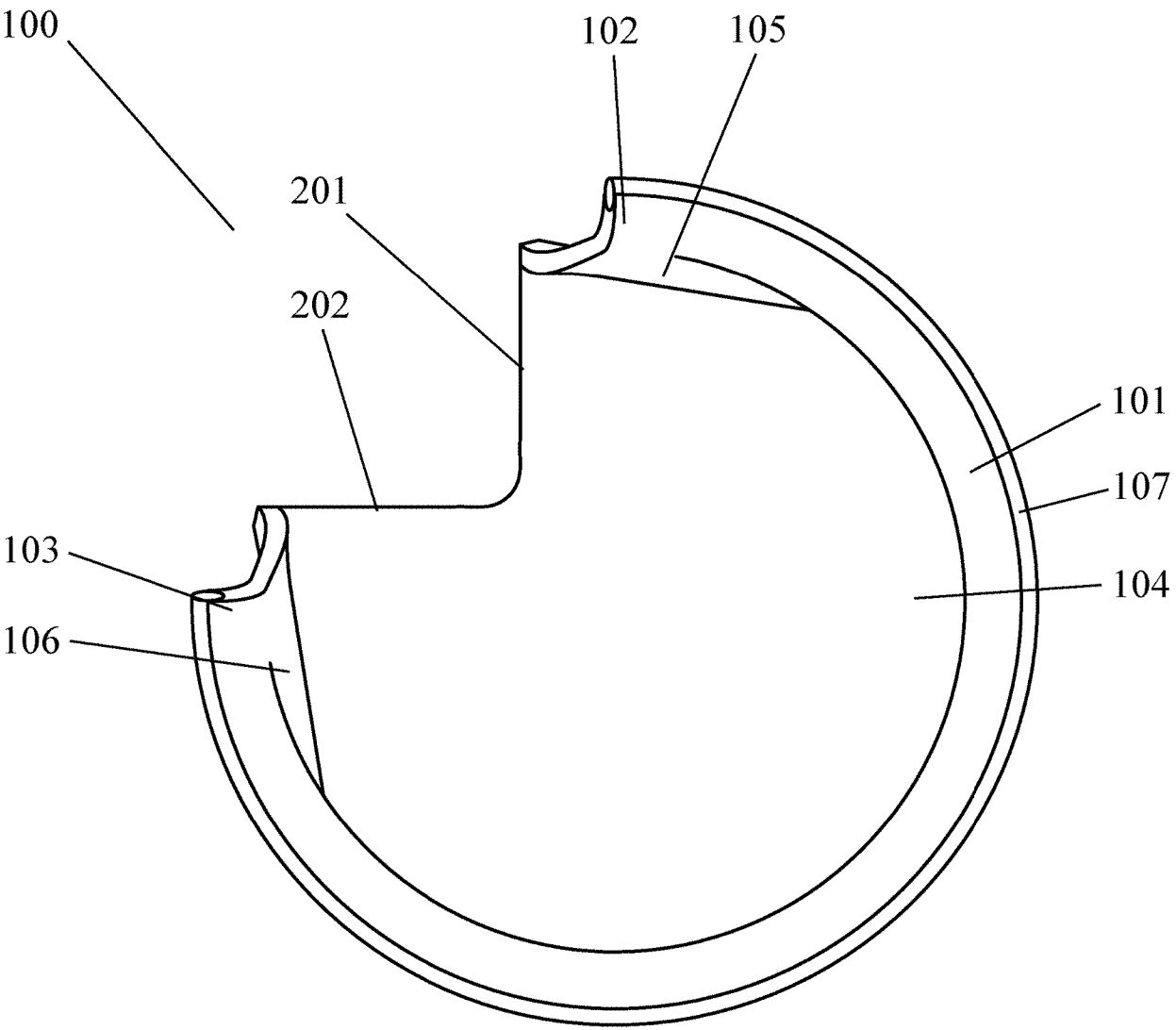
FIGS. 4-5 depict top and bottom views of the drain funnel embodiment of FIG. 1.
Figure 5:
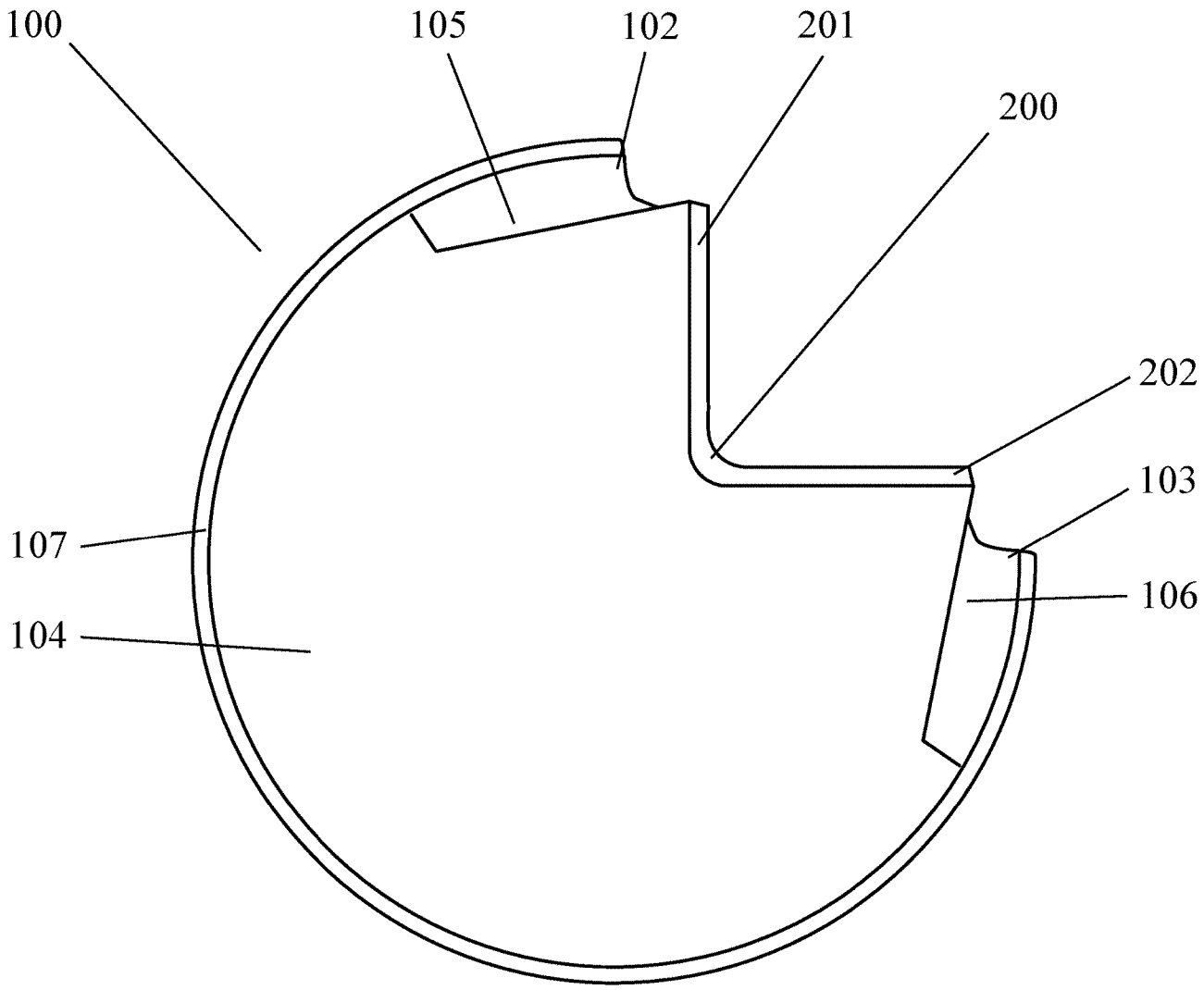

Referring to FIGS. 4-5, a top and bottom view of the drain funnel 100 are illustrated, respectively. In this embodiment, the first sidewall 105 and the second sidewall 106 are configured so that their curvature is substantially similar to the curvature of the ring 101. In some embodiments, the curvature of the first sidewall 201 and the second sidewall 202 may not be substantially similar to the curvature of the ring 101. In some embodiments, the first sidewall 201 and the second sidewall 202 may have no curvature. In this embodiment, the angle between the first bottom edge 201 and the second bottom edge 202 is approximately 90 degrees. In some embodiments, the angle between the first bottom edge and the second bottom edge may be substantially greater than 90 degrees or substantially smaller than 90 degrees. In this embodiment, the angle formed by the first bottom edge and the second bottom edge allows the bottom surface to delineate approximately a quadrant of the drain. In other embodiments, the bottom surface may delineate substantially more than a quadrant of the drain or substantially less than a quadrant of the drain.

Figure 6:
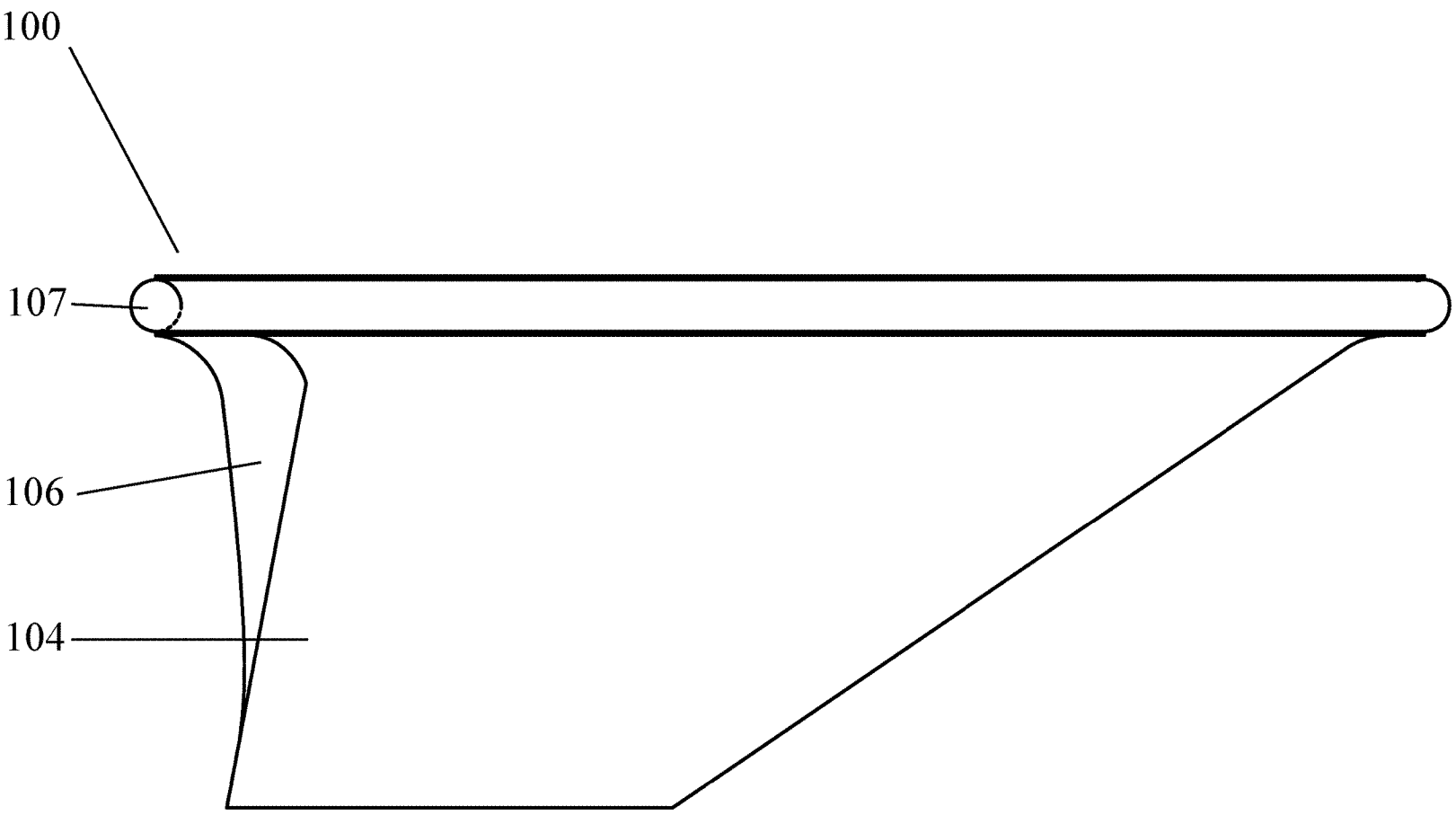
FIGS. 6-7 depict two different side views of the drain funnel embodiment of FIG. 1.
Figure 7:
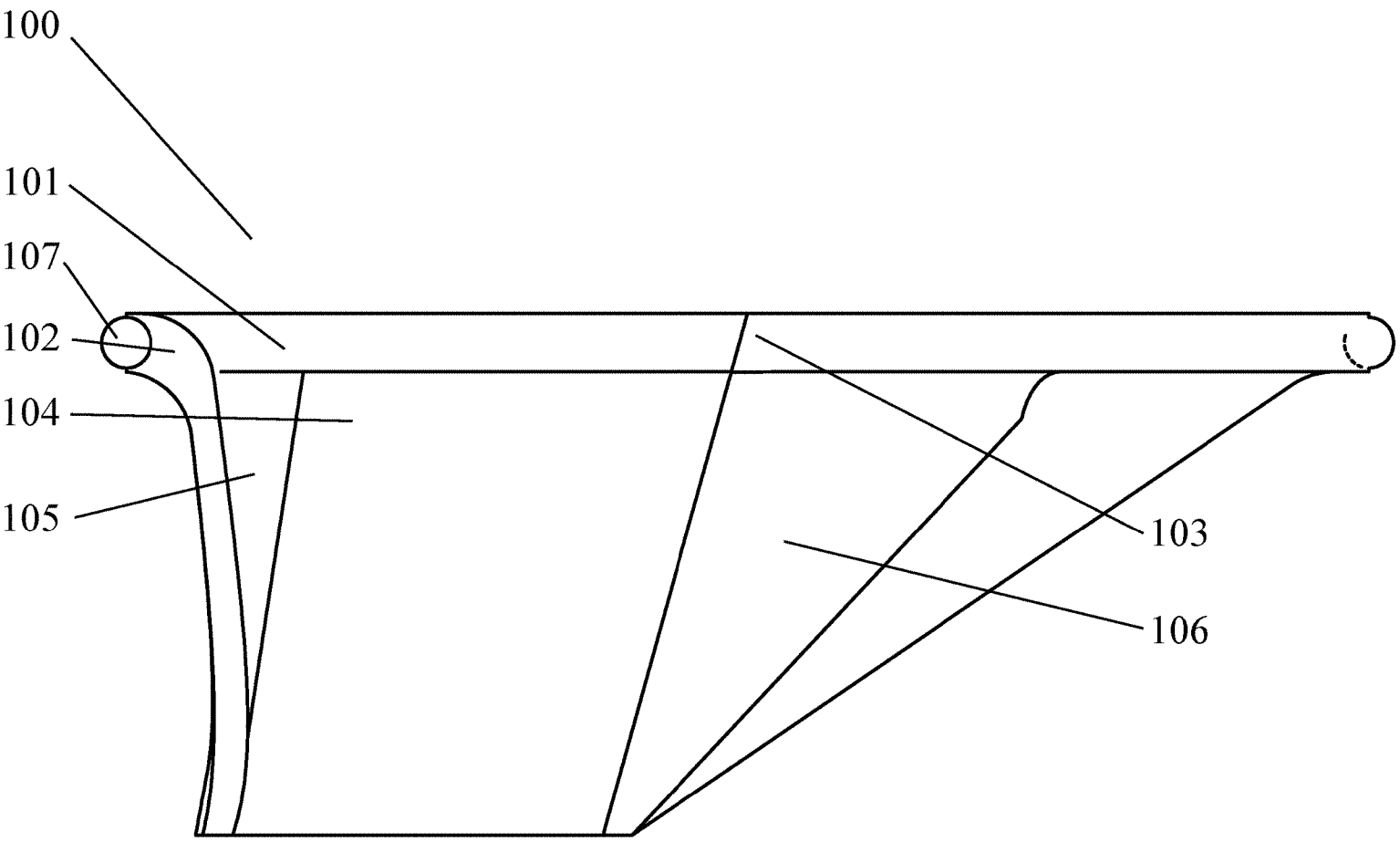

Referring to FIGS. 6-7, two different side views of the drain funnel 100 are illustrated, respectively. In this embodiment, the chute is defined by a lofting function that takes as parameters the ring 101 and the bottom surface 200 and defines a continuous series of planar sections along a linear path between them. The surface of the chute 104 may also be defined by a frustum or a frusto-conical.

Figure 8:
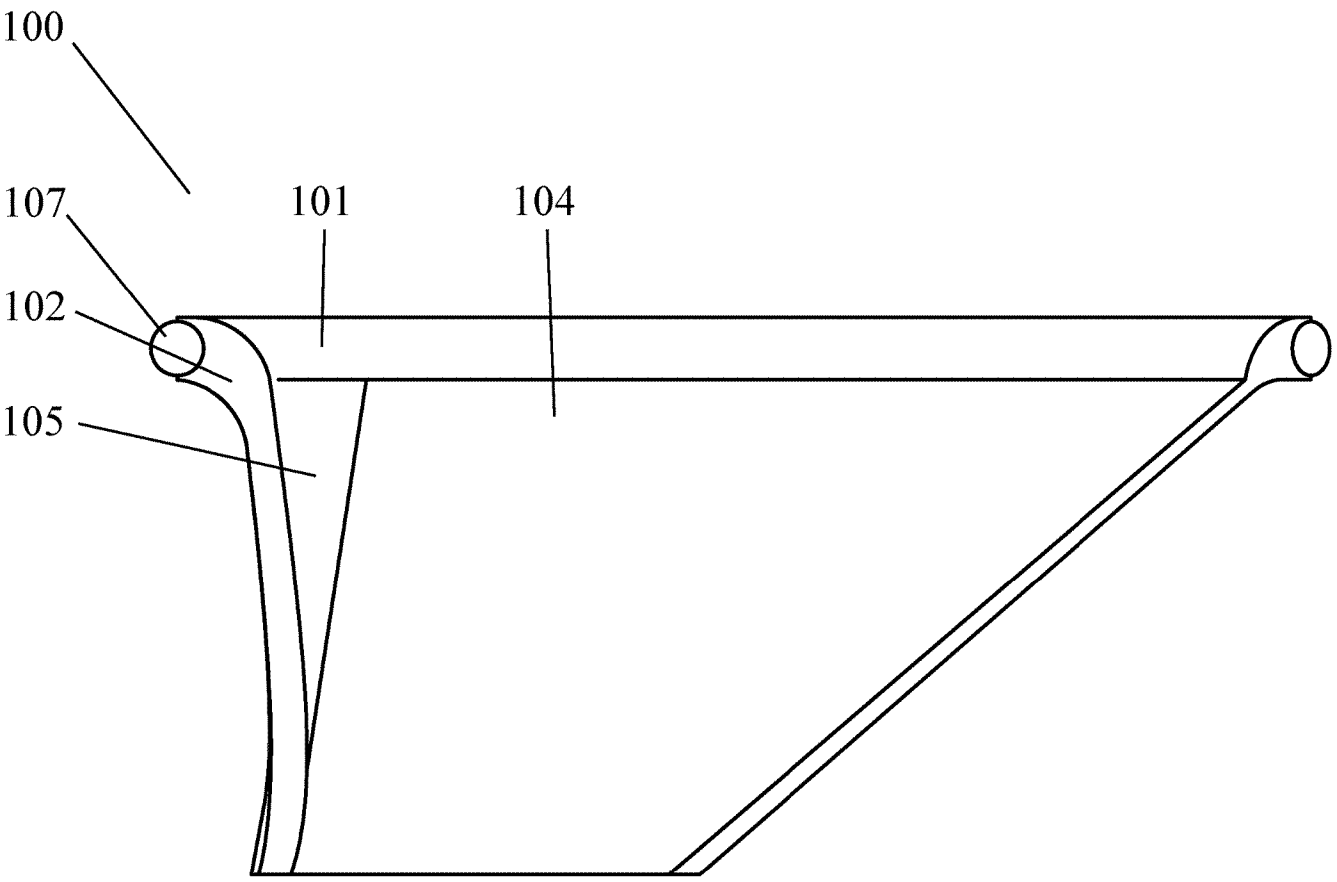
FIG. 8 depicts a cutaway view of the drain funnel embodiment of FIG. 1.

Referring to FIG. 8, a cutaway view of the drain funnel 100 is illustrated. In this embodiment 100, the thickness of the ring 101 is greater than the thickness of the chute 104. In some embodiments, the thickness of the ring 101 may be the same as the thickness of the chute 104, or thinner than the thickness of the chute 104. In this embodiment, the gasket 107 is coupled to a channel in the ring 101.

Figure 9:
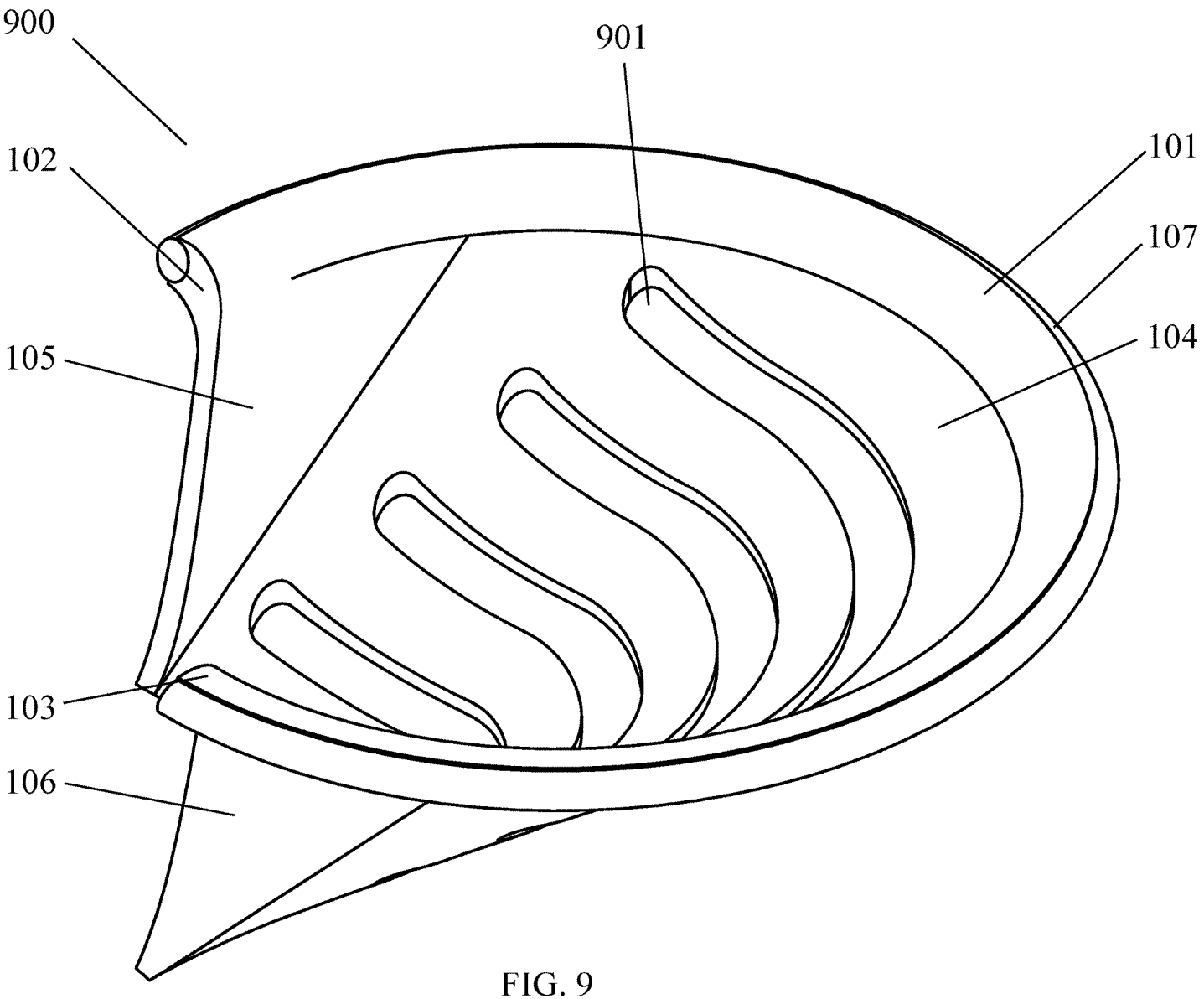
FIGS. 9-10 depict elevated and depressed perspective views of an embodiment of the drain funnel with slits.
Figure 10:
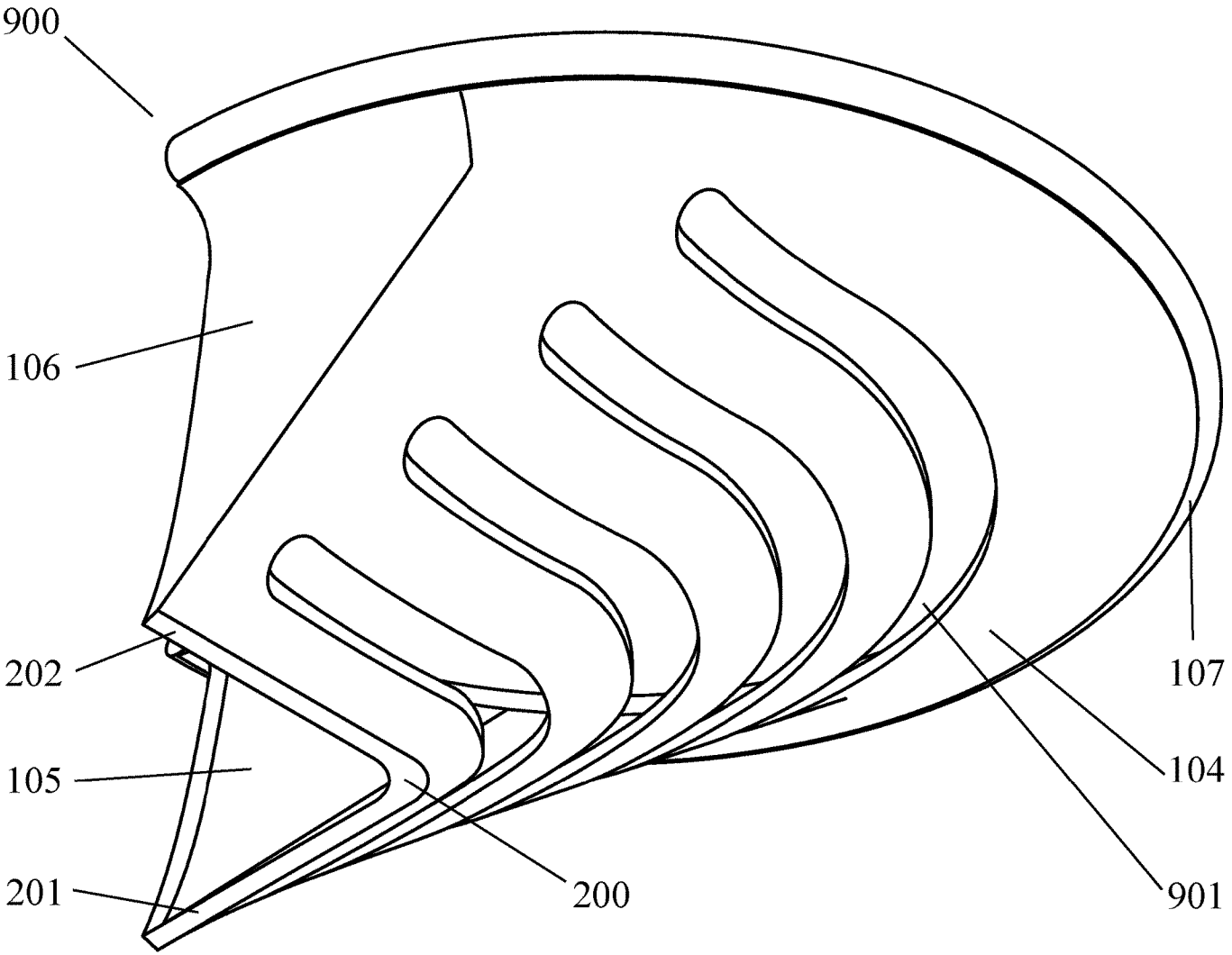

Referring to FIGS. 9-10, an elevated and depressed perspective view of an embodiment of the drain funnel 900 are illustrated, respectively, according to an embodiment of the invention. In this embodiment, the chute 104 comprises at least one slit 901. In this embodiment, the slits 901 are oriented so that they are substantially perpendicular to the flow of water down the chute, thus preventing debris flow through the slits 901. In this embodiment, the width of the slits 901 is configured so that the surface tension of the liquid flowing over them is maintained, thus preventing fluid flow through the slits 901. In this embodiment, the slits 901 are positioned so that they are substantially equidistant from each other on the surface of the chute 104. In other embodiments, the slits 901 may be spaced irregularly on the surface of the chute 104.

Figure 11:
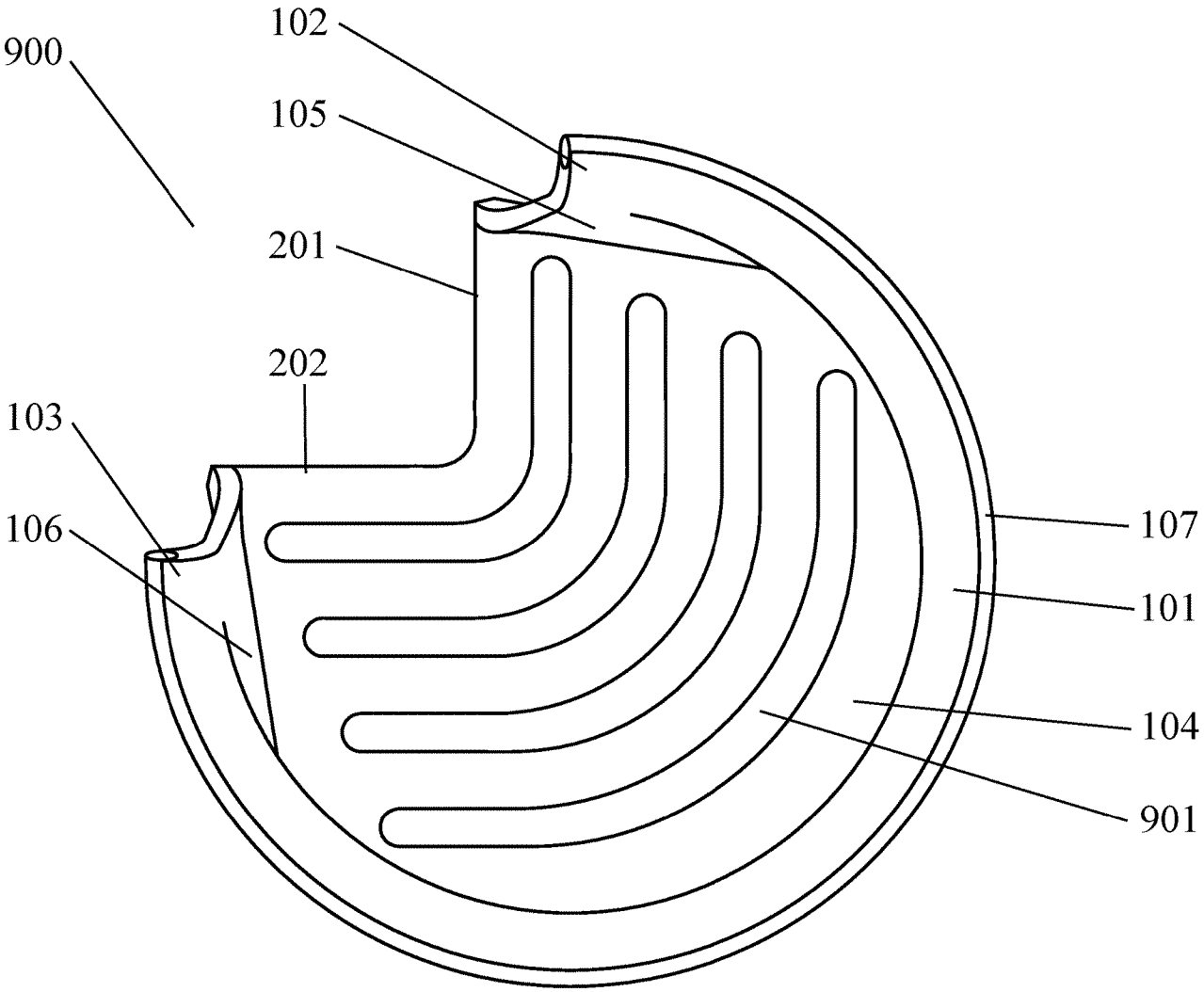
FIGS. 11-12 depict top and bottom views of the drain funnel embodiment of FIG. 9.
Figure 12:
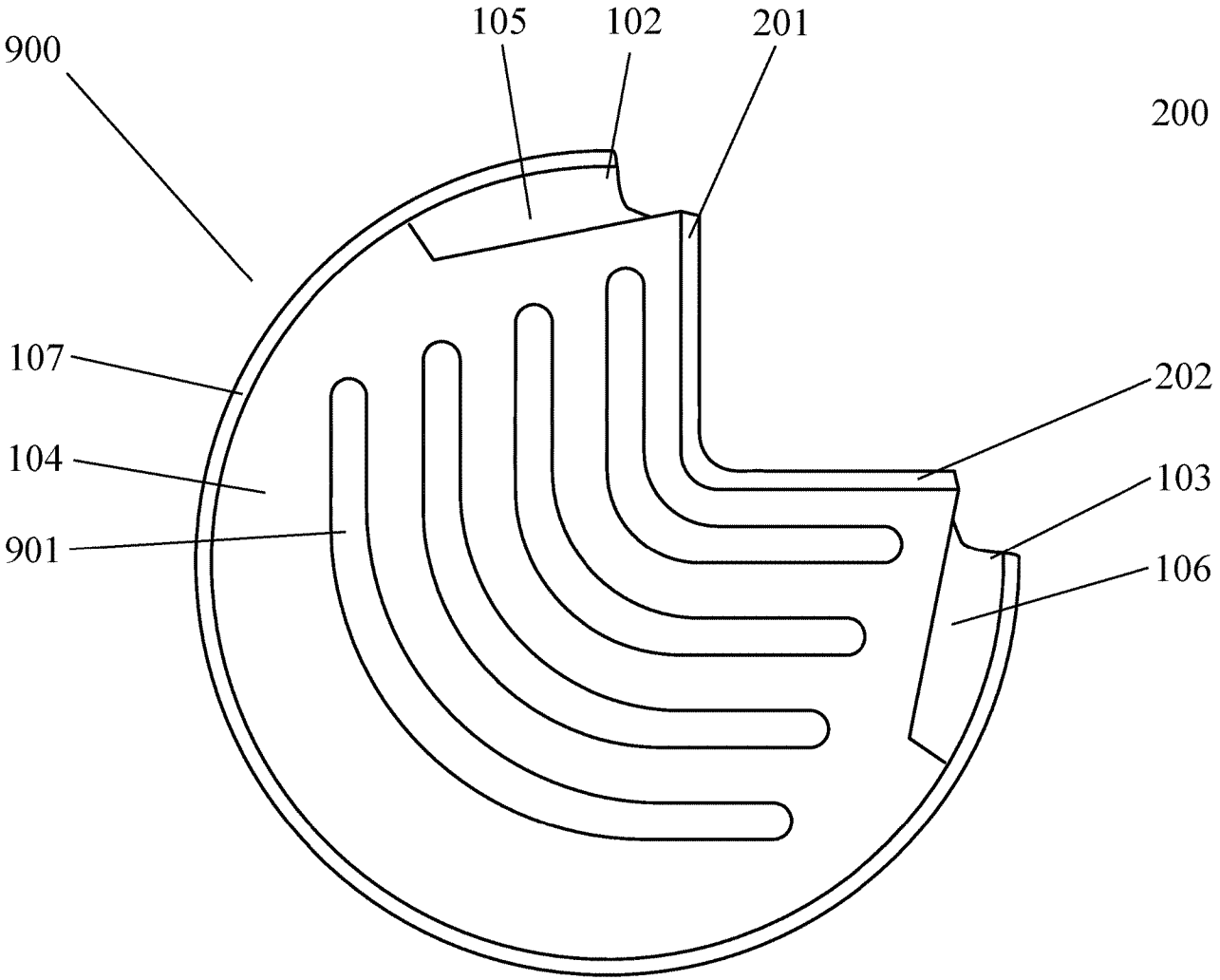

Referring to FIGS. 11-12, a top and bottom view of the drain funnel 900 are illustrated, respectively. The slits 901 are defined by a projection of a polygon on to the surface of the chute 104 from the plane of the bottom surface 200. The polygon is projected from the plane of the bottom surface onto the surface of the chute by mapping each of the points of the polygon along a path perpendicular to the plane of the bottom surface to the point where the path intersects the surface of the chute 104. In this embodiment, the slits 901 are defined by the projection of a concave, equiangular hexagon. In other embodiments, the slits 901 may be defined by the projection of a triangle, quadrilateral, pentagon, or other polygon. In this embodiment, each of the vertices of the hexagon have been filleted according to a radius.

Figure 13:
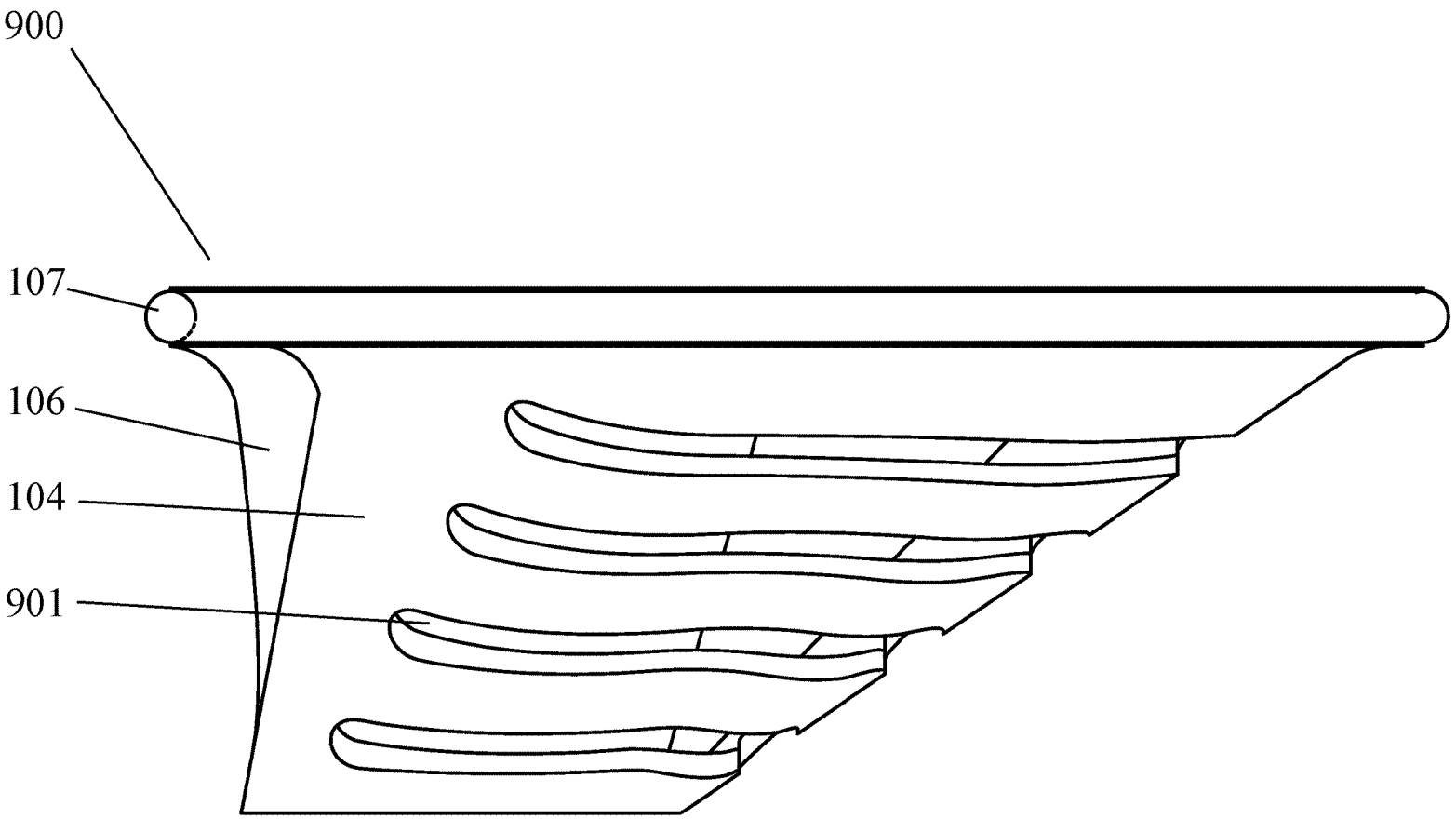
FIGS. 13-14 depict different side views of the drain funnel embodiment of FIG. 9.
Figure 14:
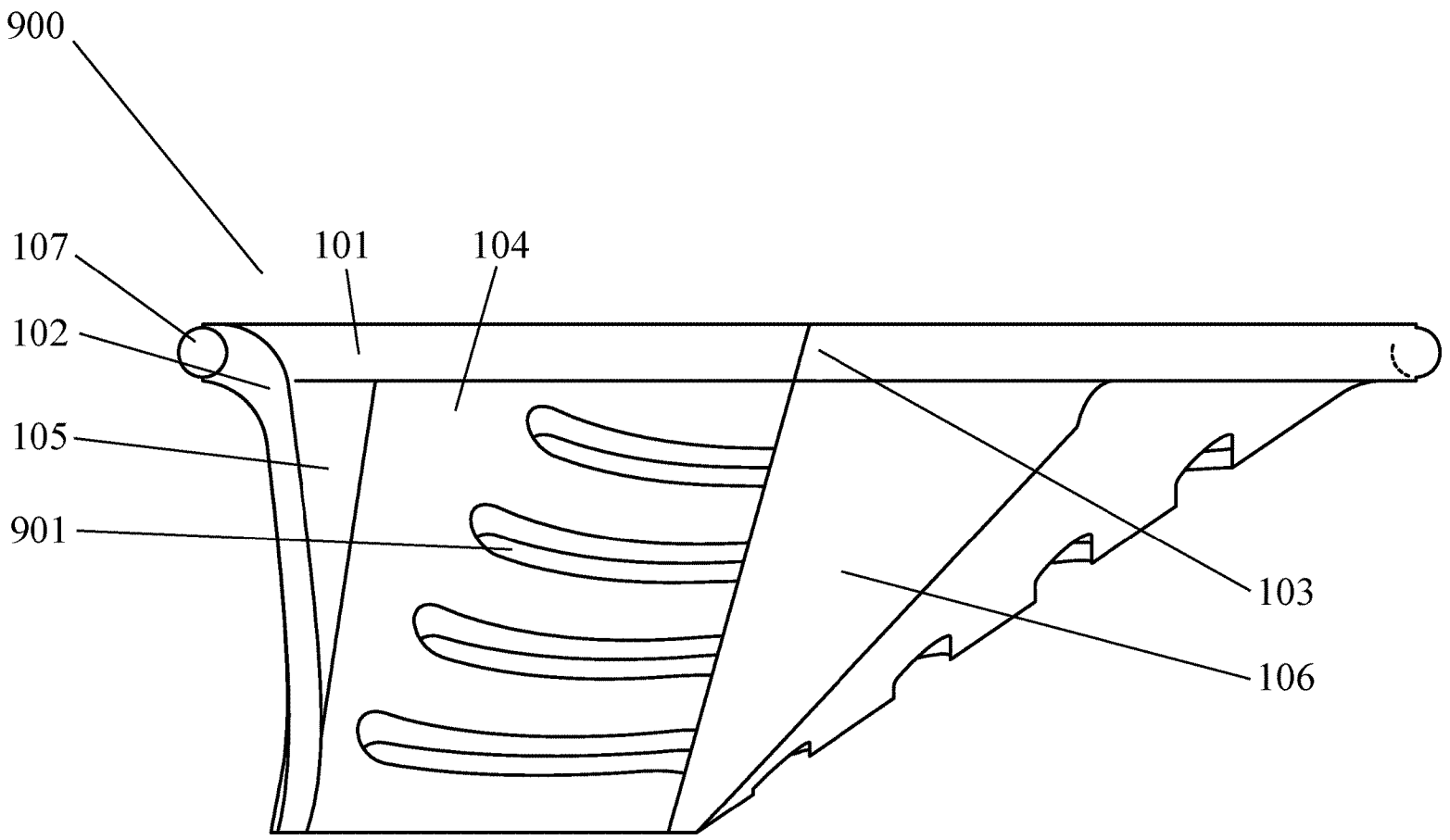
Figure 15:
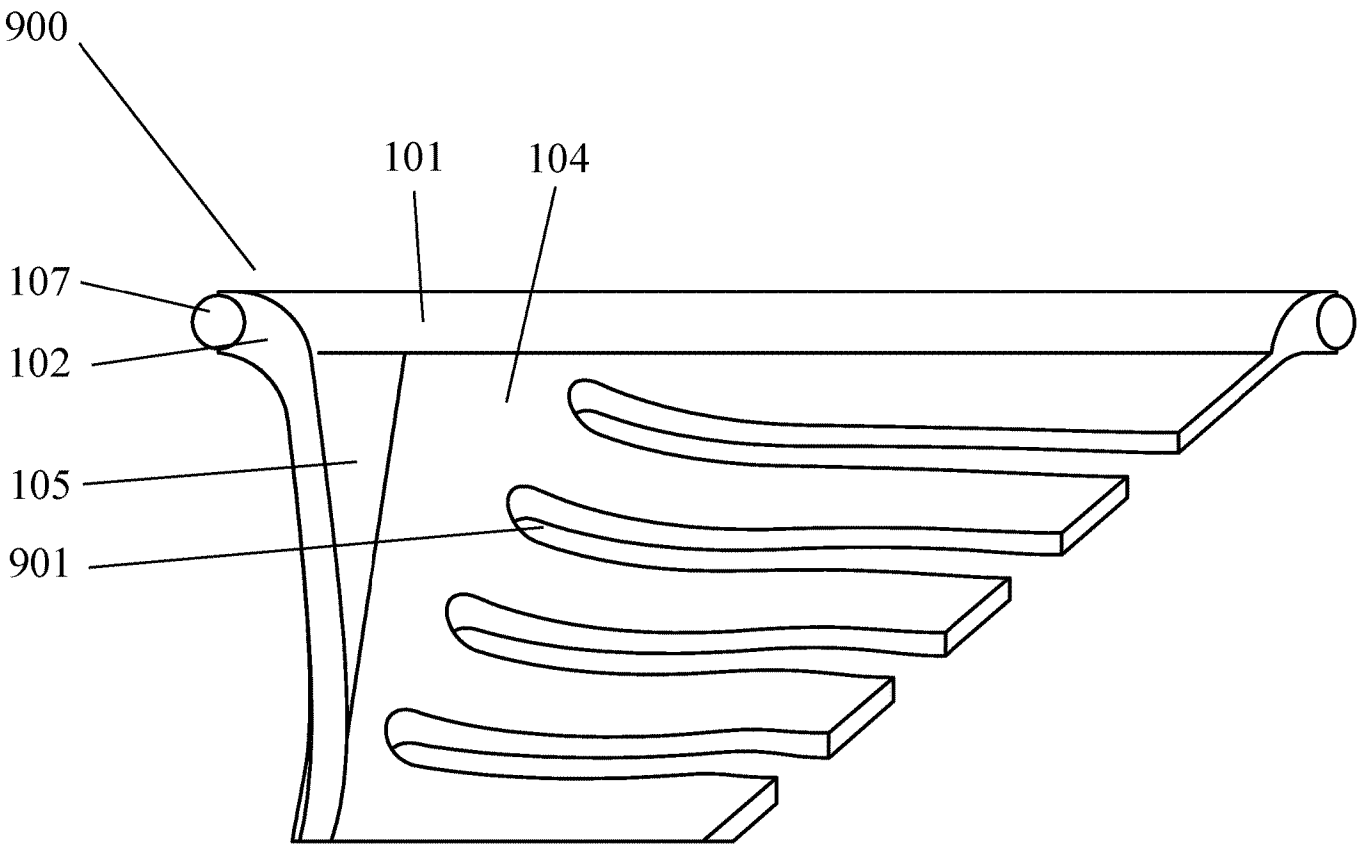
FIG. 15 depicts a cutaway view of the drain funnel embodiment of FIG. 9.

Referring to FIGS. 13-15, two different side views and a cutaway view of the drain funnel 900 are illustrated, respectively. The slope and thickness of the ring 101 relative to the slope and thickness of the chute 104 in this embodiment is illustrated. In this embodiment, the gasket 107 is coupled to a channel in the ring 101.

Figure 16:
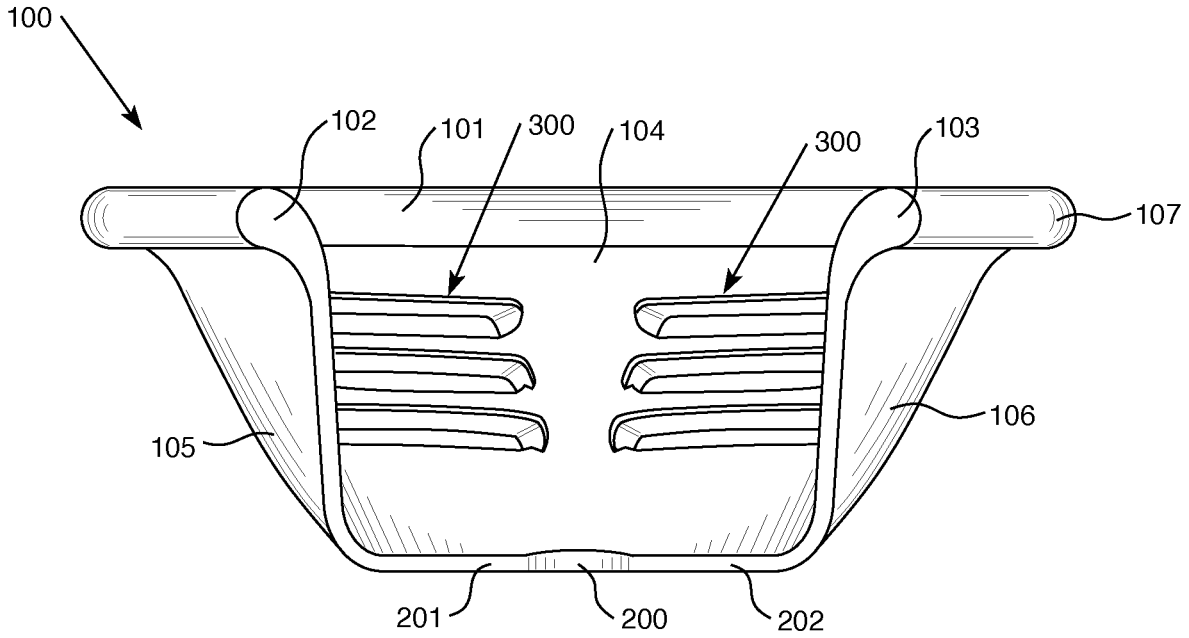
FIG. 16-17 depict front and rear views of a drain funnel embodiment comprising louvers.
Figure 17:
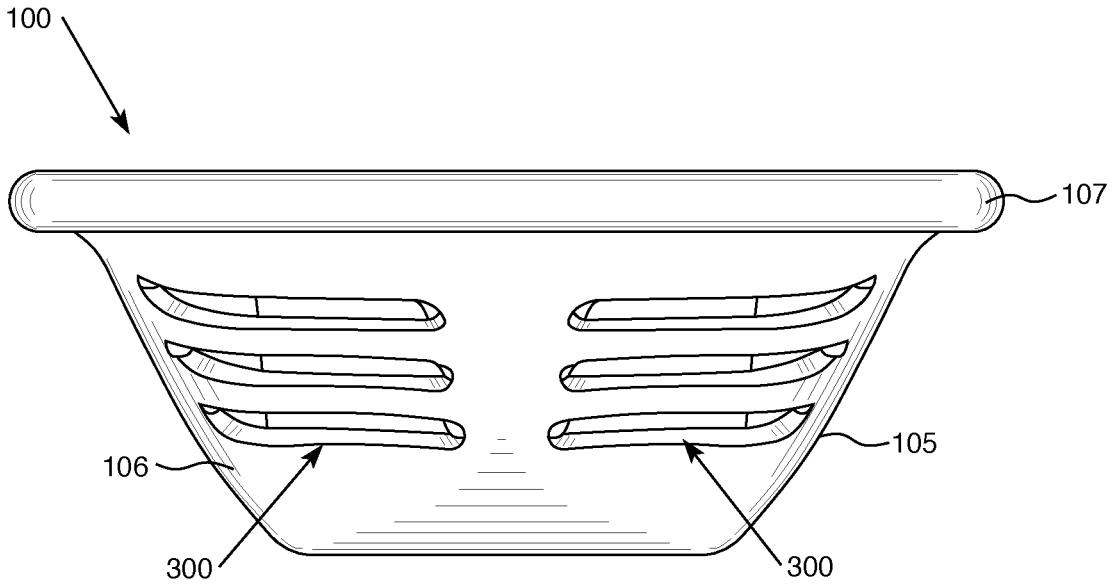

Referring to FIGS. 16-17, front view and rear view of the drain funnel 100 are illustrated, respectively with one or more louvers 300. In this embodiment, the louvers 300 are oriented so that they are substantially perpendicular to the flow of water down the chute, thus preventing debris flow through the louvers 300. In this embodiment, the louvers 300 are configured so that liquid flowing over them is maintained, thus preventing fluid flow through the louvers 300 allowing air to escape through the louvers 300. In this embodiment, the louvers 300 are positioned so that they are substantially equidistant from each other on the surface of the chute 104. In other embodiments, the louvers 300 may be spaced irregularly on the surface of the chute 104.

Figure 18:
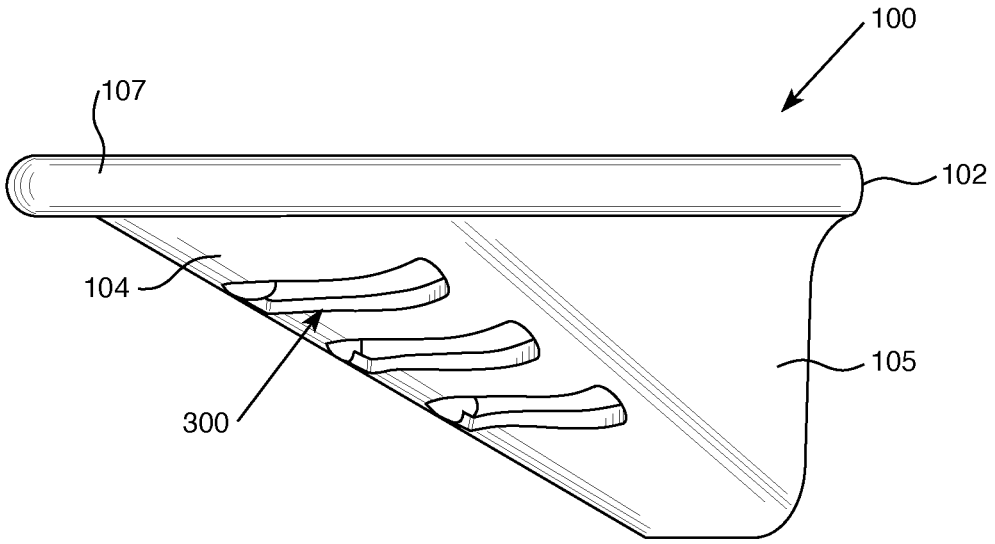
FIG. 18-19 depict left and right side views of a drain funnel embodiment comprising louvers.
Figure 19:
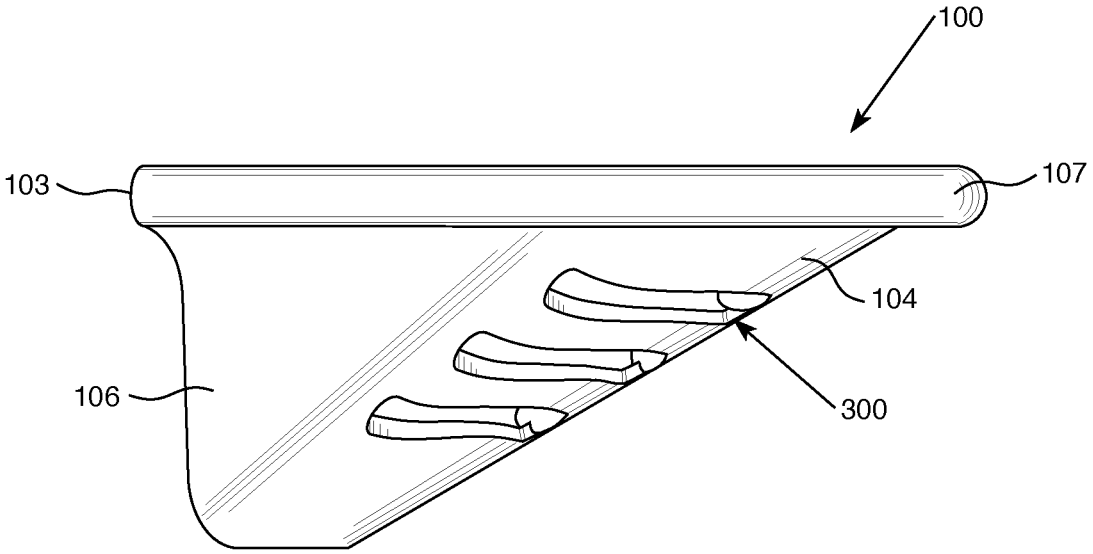

Referring to FIGS. 18-19, the right side view and left side view of the drain funnel 100 are illustrated. In this embodiment, the slope and thickness of the ring 101 relative to the slope and thickness of the chute 104 is illustrated. In this embodiment, the gasket 107 is coupled to a channel in the ring 101. The louvers 300 are shown so that they are located within the chute 104 of the drain funnel 100. In other embodiments (not shown), the louvers may be located on the bottom side of the chute 104.

Figure 20:
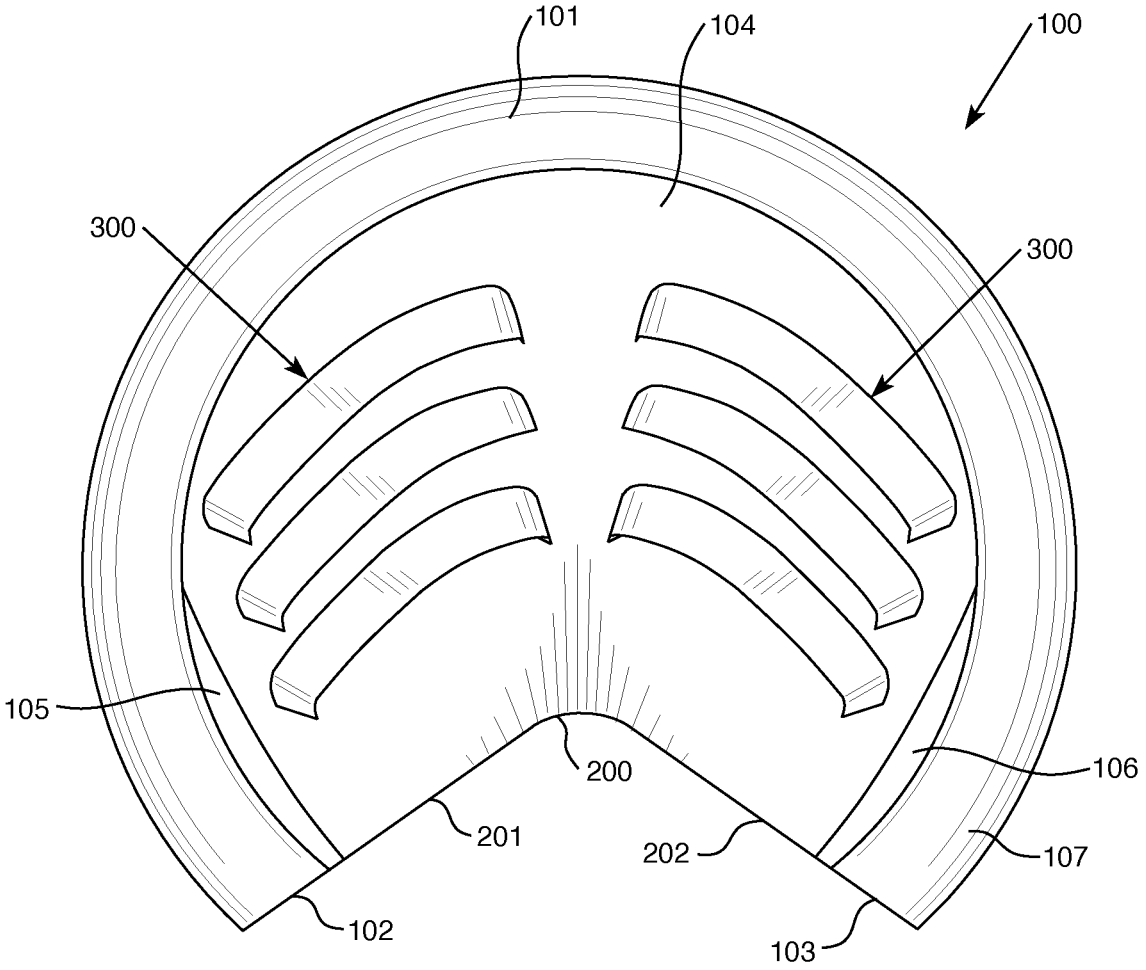
FIG. 20-21 depict a top view of a drain funnel embodiment comprising louvers.
Figure 21:
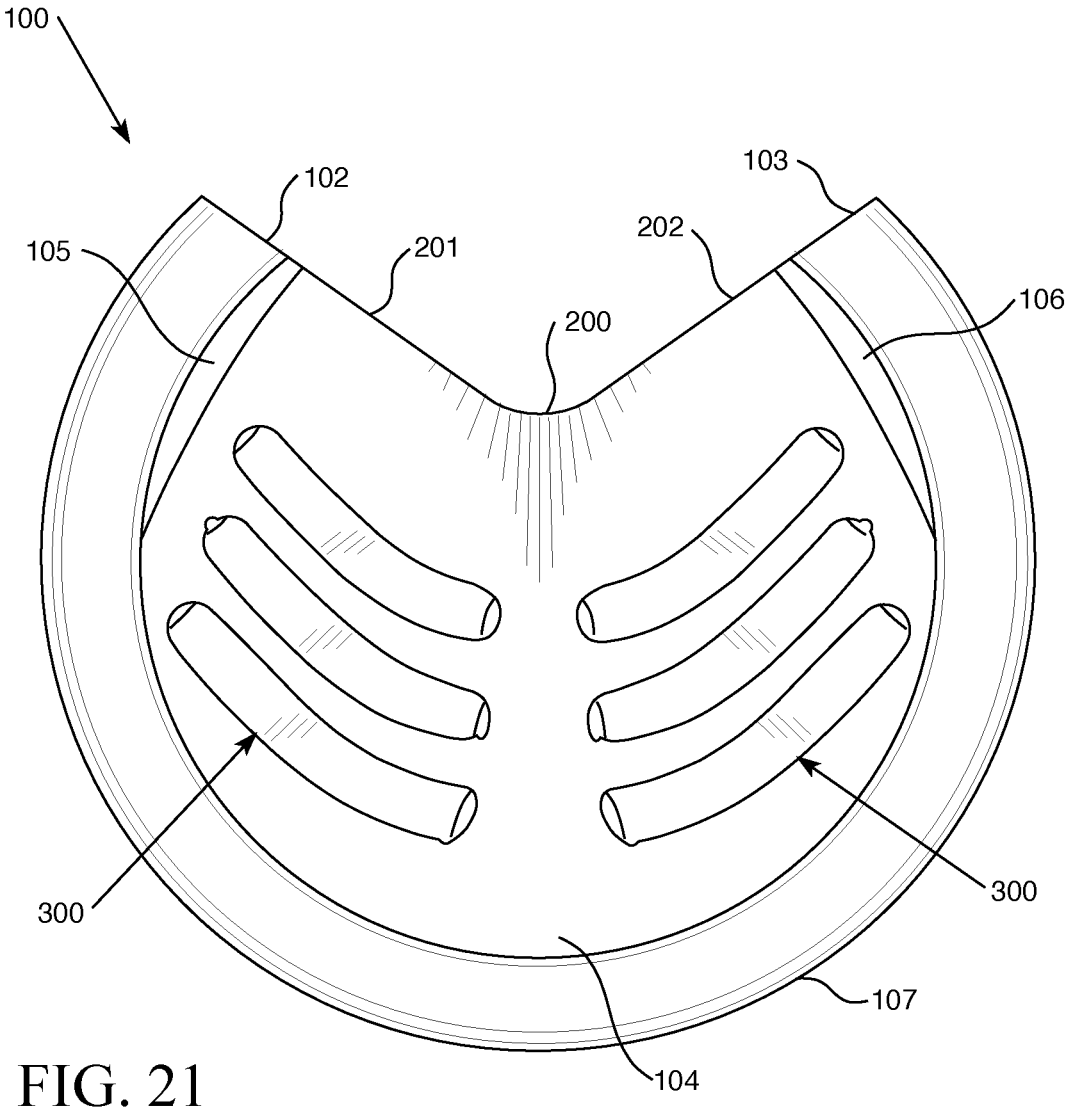

FIGS. 20-21, are top views of the drain funnel 100. In this embodiment, the angle between the first bottom edge 201 and the second bottom edge 202 is approximately 90 degrees. In some embodiments, the angle between the first bottom edge and the second bottom edge may be substantially greater than 90 degrees or substantially smaller than 90 degrees. In this embodiment, the angle formed by the first bottom edge 201 and the second bottom edge 202 allows the bottom surface to delineate approximately a quadrant of the drain. In other embodiments, the bottom surface may delineate substantially more than a quadrant of the drain or substantially less than a quadrant of the drain.

Figure 22:
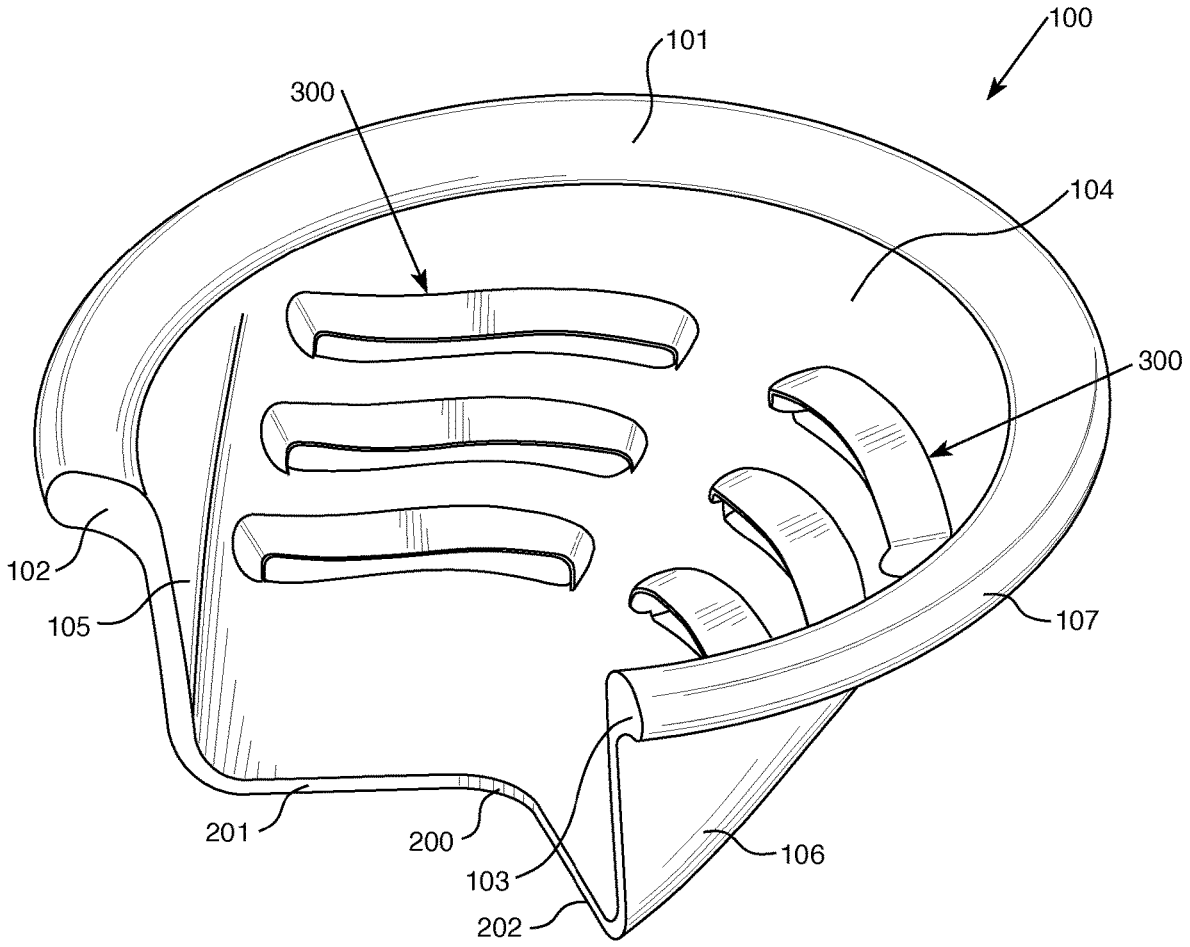
FIG. 22 depicts an elevated view of a drain funnel embodiment comprising louvers.

FIG. 22 illustrates the embodiment of the drain funnel 100 in an elevated view where position of the louvers 300 are shown on the top side of the chute 104.

In places where the description above refers to particular implementations of a drain funnel, it should be readily apparent that a number of modifications may be made without departing from the spirit thereof and that these implementations may be applied to other drain-related devices.

The invention claimed is:

1. A funnel for a drain in a basin, comprising:

a ring, wherein the ring extends from a first ring terminus to a second ring terminus and is configured to fit within a drain;

a bottom surface comprising a first bottom edge and a second bottom edge and configured to rest on a cross-bar of a drain thereby delineating at least one quadrant of a drain;

a chute, coupled to the ring and the bottom surface and configured to loft from the ring to the bottom surface; and a first sidewall and a second sidewall configured to couple to the ring, the bottom edge, and the chute, wherein the first ring terminus, the second ring terminus, the first bottom edge, the second bottom edge, the first sidewall, and the second sidewall form a void space disposed there between.

2. The funnel of claim 1, wherein the ring, the bottom surface, the chute, the first sidewall, and the second sidewall comprise a thermoplastic elastomer.

3. The funnel of claim 2, wherein the thermoplastic comprises at least one of an acrylonitrile butadiene styrene and a polyethylene.

4. The funnel of claim 1, wherein the ring, the bottom surface, the chute, the first sidewall, and the second sidewall comprise a silicone.

5. The funnel of claim 1, wherein the ring, the bottom surface, the chute, the first sidewall, and the second sidewall comprise an antimicrobial additive.

6. The funnel of claim 1, wherein the ring, the bottom surface, the chute, the first sidewall, and the second sidewall are coated in a hydrophobic coating.

7. The funnel of claim 1, wherein the ring, the bottom surface, the chute, the first sidewall, and the second sidewall are coated in an antimicrobial coating.

8. The funnel of claim 1, wherein the ring extends through approximately 270 degrees.

9. The funnel of claim 1, wherein the ring is coupled to a gasket.

10. The funnel of claim 9, wherein the gasket comprises a thermoplastic elastomer.

11. The funnel of claim 10, wherein the gasket comprises a silicone rubber.

12. The funnel of claim 1, wherein the first bottom edge and the second bottom edge are disposed at a right-angle with respect to one another.

13. The funnel of claim 1, wherein the chute comprises at least one slit.

14. The funnel of claim 13, wherein the at least one slit is defined by a projection of a polygon onto a surface of the chute from a plane of the bottom surface.

15. The funnel of claim 14, wherein the angles of the polygon are filleted according to a plurality of radii.

16. The funnel of claim 15, wherein the polygon comprises a concave equiangular hexagon.

17. The funnel of claim 1, wherein the chute comprises at least one louver.

18. The funnel of claim 17, wherein the louver comprises a thermoplastic elastomer.

19. The funnel of claim 1, wherein a curvature of the first sidewall and a curvature of the second sidewall is identical to a curvature of the ring.

20. A method of diverting the flow of liquid and debris around a crossbar of a drain, comprising the steps of:

compressing a ring of a funnel and a chute of the funnel by applying converging forces to a first ring terminus and a second ring terminus or a first sidewall and a second sidewall so that a void space defined by the first ring terminus, the second ring terminus, the first sidewall, the second sidewall, a first bottom edge, and a second bottom edge is narrowed and a diameter of the ring is made smaller than a diameter of the drain;

inserting the chute of the funnel into an interior of the drain so that the bottom surface of the funnel rests on the crossbar of the drain and the ring of the funnel rests on the interior of the drain;

orienting the chute of the funnel so that the bottom surface delineates approximately a quadrant of the drain; and releasing the compression of the ring of the funnel and the chute of the funnel so that the ring expands against the interior of the drain.

* * * * *